US010334343B2

(12) United States Patent
Lu et al.

(10) Patent No.: US 10,334,343 B2
(45) Date of Patent: Jun. 25, 2019

(54) INTEGRATED ANNULAR HEADPHONE

(71) Applicants: DEXIN ELECTRONIC LTD., Dongguan, Guangdong (CN); DEXIN CORPORATION, New Taipei (TW)

(72) Inventors: Ho-Lung Lu, New Taipei (TW); Kuan-Ling Chen, New Taipei (TW)

(73) Assignees: DEXIN ELECTRONICS LTD., Dongguan, Guangdong (CN); DEXIN CORPORATION, New Taipei (TW)

( * ) Notice: Subject to any disclaimer, the term of this patent is extended or adjusted under 35 U.S.C. 154(b) by 0 days.

(21) Appl. No.: 15/795,848

(22) Filed: Oct. 27, 2017

(65) Prior Publication Data

US 2019/0132663 A1 May 2, 2019

(51) Int. Cl.
*H04R 1/10* (2006.01)

(52) U.S. Cl.
CPC ..... *H04R 1/1008* (2013.01); *H04R 1/1075* (2013.01); *H04R 2201/107* (2013.01)

(58) Field of Classification Search
CPC ..... H04R 5/0335; H04R 2201/103; H04R 1/1075; H04R 1/1041; H04R 1/1033; H04R 1/1066; H04R 1/1058; A42C 5/02
See application file for complete search history.

(56) References Cited

U.S. PATENT DOCUMENTS 2,865,027 A * 12/1958 Shapiro ..... A42B 1/22 2/195.3
3,931,646 A * 1/1976 Loughner ..... A61F 9/027 2/452
4,864,619 A * 9/1989 Spates ..... H04R 1/10 381/309
5,303,426 A * 4/1994 Jones ..... A41D 20/00 2/181
5,881,390 A * 3/1999 Young ..... A41D 20/00 2/209.13
9,968,152 B2 * 5/2018 Chiang ..... A42B 1/245
2008/0044052 A1 * 2/2008 Whipple ..... A42B 1/245 381/376

(Continued)

FOREIGN PATENT DOCUMENTS

CN 202907150 * 4/2013 ..... H04R 1/10
CN 202907150 U 4/2013

(Continued)

*Primary Examiner* — Oyesola C Ojo
(74) *Attorney, Agent, or Firm* — Li & Cai Intellectual Property (USA) Office

(57) ABSTRACT

An integrated annular headphone includes an annular headband and a pair of speaker modules. The annular headband has a first half section, a second half section and two retaining portions. The first half section is connected to the second half section in a closed manner. The two retaining portions are respectively disposed at two sides of the annular headband. Each retaining portion has an inner opening, an outer opening and a receiving chamber between the inner opening and the outer opening. The pair of speaker modules are respectively retained in the retaining portions. Each speaker module has an ear cover, a housing and an electroacoustic transducer disposed in the housing. The ear cover is fixed to the inner opening. The housing is partially exposed outside the outer opening. The electroacoustic transducer faces the inner opening.

18 Claims, 9 Drawing Sheets

(56) References Cited

U.S. PATENT DOCUMENTS

| | | | | |
|---|---|---|---|---|
| 2008/0144872 | A1* | 6/2008 | Phillips | H04R 5/0335 381/333 |
| 2008/0181429 | A1* | 7/2008 | Fried | A42B 1/245 381/87 |
| 2008/0304691 | A1* | 12/2008 | Lai | H04R 5/0335 381/386 |
| 2011/0016613 | A1* | 1/2011 | Warrick | A42B 1/064 2/209.11 |
| 2014/0328508 | A1* | 11/2014 | Jacks | H04R 1/1008 381/376 |
| 2015/0092972 | A1* | 4/2015 | Lai | H04R 1/1008 381/333 |
| 2015/0281821 | A1* | 10/2015 | Oishi | H04R 1/1041 381/345 |
| 2015/0296285 | A1* | 10/2015 | Proos | H04R 1/105 381/333 |

FOREIGN PATENT DOCUMENTS

| | | | |
|---|---|---|---|
| CN | 204666953 | U | 9/2015 |
| CN | 205051842 | U | 2/2016 |
| CN | 105807425 | A | 7/2016 |

* cited by examiner

INTEGRATED ANNULAR HEADPHONE

BACKGROUND OF THE INVENTION

1. Field of the Invention

The present disclosure is related to an integrated annular headphone. In particular, the present disclosure relates to an integrated ring-type headband combined with two wearing headbands, which can be worn on a user's head for listening to sounds.

2. Description of Related Art

The current earmuff headphone has a C-shaped manner and is usually worn on a user's head, and the headphone has two speaker modules which can respectively retain on the user's ears through a clamping force. The wearing condition of the common earmuff headphone is not stable and is easily swung. In addition, the headphone is prone to affect a user's hairstyle. A headband, which is connected to the two speaker modules, is usually non-detachable from the headphone. However, the headband will get damaged after long-term use. Besides, the irreplaceable headband is not able to match the user's clothing collocation.

SUMMARY OF THE INVENTION

One of the objectives of the present disclosure is to provide an integrated annular headphone which is worn on a user's head in a surrounding manner to avoid affecting the user's hairstyle.

Another of the objectives of the present disclosure is to provide an integrated annular headphone of which the wearing headband connected with two earmuff-type speaker modules is replaceable, so that an appearance of the integrated annular headphone can be changed for matching a user's different hairstyles or clothing.

In order to achieve the above objectives, according to one exemplary embodiment of the present disclosure, an integrated annular headphone is provided which includes an annular wearing headband and a pair of speaker modules. The annular wearing headband has a first half section, a second half section and two retaining parts. The first half section is connected to the second half section to form a closed-loop manner. The two retaining parts are respectively disposed at two sides of the annular wearing headband. Each of the retaining parts is formed with an inner opening, an outer opening and a receiving chamber. The receiving chamber is arranged between the inner opening and the outer opening. The pair of speaker modules are respectively retained in the retaining parts. Each of the speaker modules has an ear cover, a housing and an electroacoustic transducer disposed in the housing. The ear cover is fixed to the inner opening. The housing is partially exposed outside the outer opening. The electroacoustic transducer faces the inner opening.

Thus, the present disclosure has the advantages as follows. The integrated annular headphone of the present disclosure uses a retractable and replaceable annular wearing headband to connect two speaker modules, which is surrounding a user's forehead and back head and is different from the conventional C-shaped earmuff headphone which clamps a user's head. A user can put on the integrated annular headphone like putting on a headband or a headscarf without affecting the user's hairstyle. In addition, the wearing headband of the integrated annular headphone of the present disclosure is easy to dismount, thereby contributing to changing or washing the wearing headband for matching a user's different hairstyles or clothes, so as to create a personal style.

For further understanding of the present disclosure, reference is made to the following detailed description illustrating the embodiments and examples of the present disclosure. The description is for illustrative purposes only and is not intended to limit the scope of the claim.

DETAILED DESCRIPTION OF THE EXEMPLARY EMBODIMENTS

Figure 1:
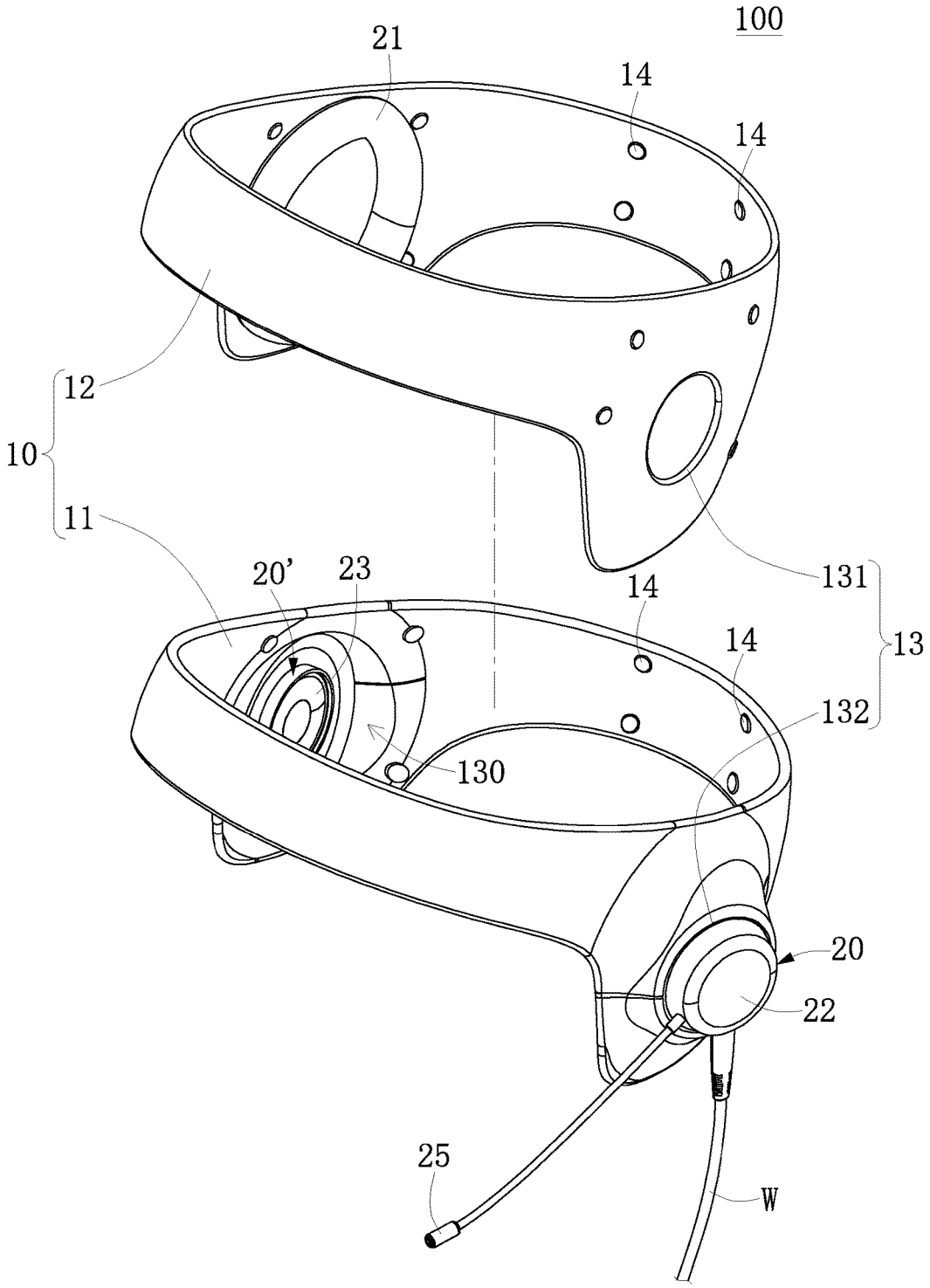
FIG. 1 is an exploded perspective view of an integrated annular headphone according to the present disclosure.
Figure 2:
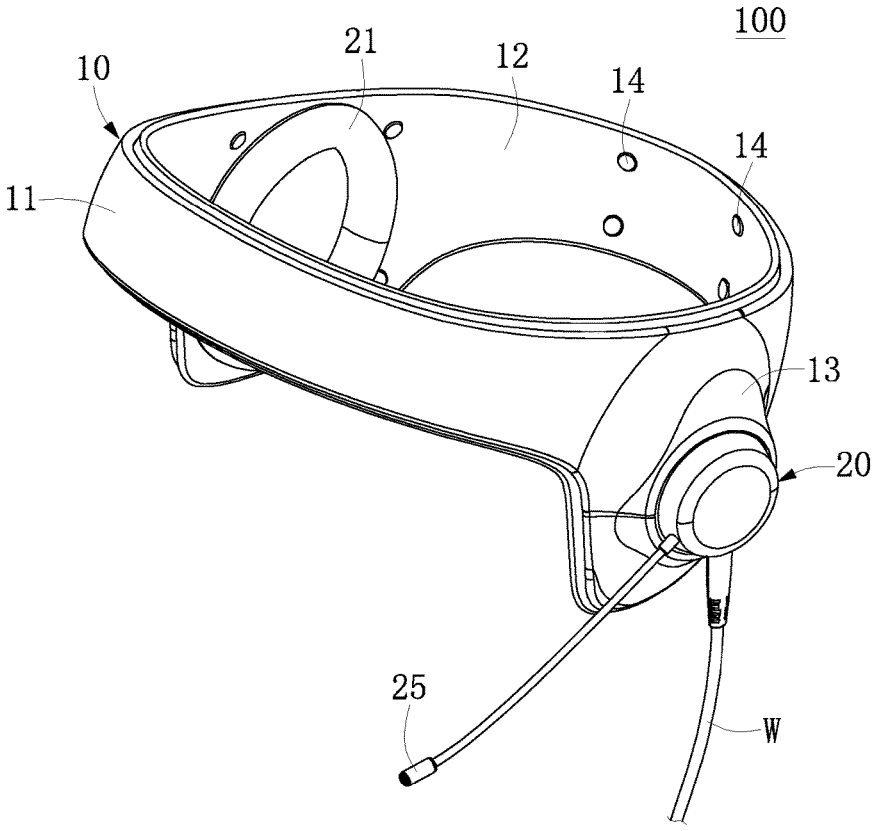
FIG. 2 is an assembled perspective view of the integrated annular headphone according to the present disclosure.
Figure 3:
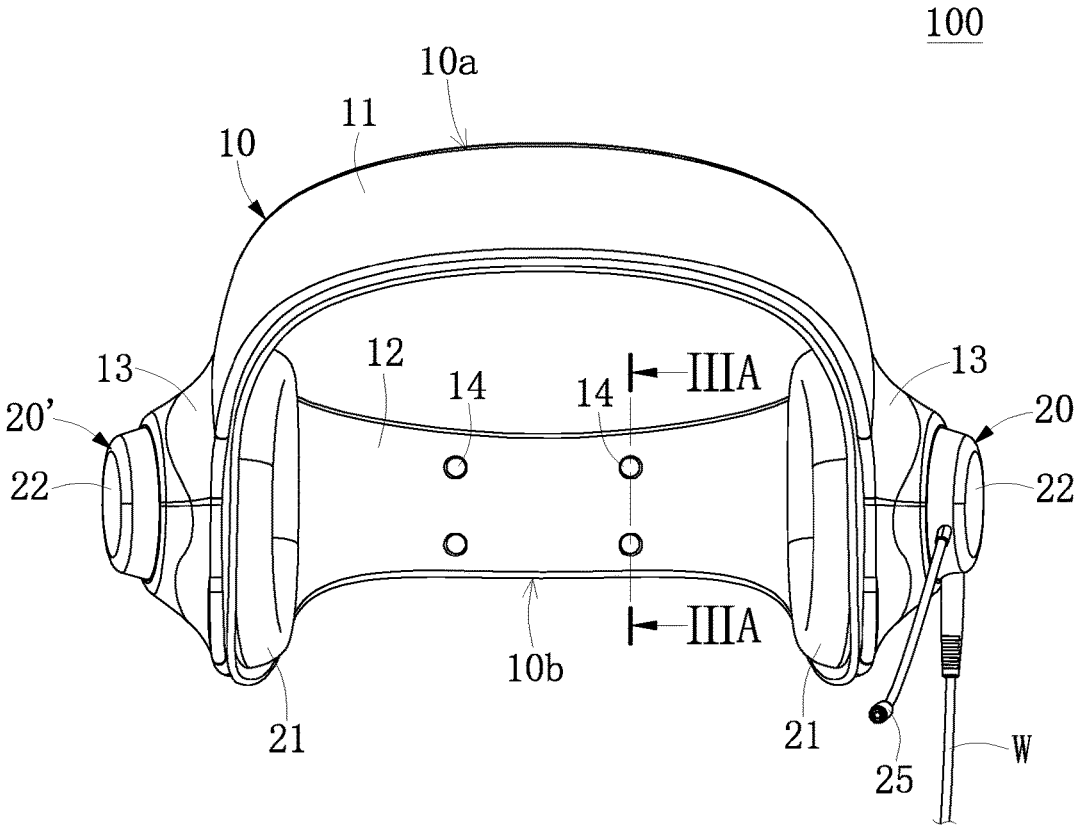
FIG. 3 is a front view of the integrated annular headphone according to the present disclosure.

Reference is made to FIG. 1 to FIG. 3, which are respectively an exploded perspective view, an assembled perspective view, and a front view of an integrated annular headphone according to the present disclosure. The present disclosure provides an integrated annular headphone 100, which includes an annular wearing headband 10 and a pair of speaker module 20, 20', so as to form an integrated annular headphone of a sports style.

The annular wearing headband 10 has a first half section 10*a*, a second half section 10*b* (as shown FIG. 3) and two retaining parts 13. The first half section 10*a* is connected to the second half section 10*b*, so as to form a closed-loop manner. The two retaining parts 13 are disposed at two sides of the annular wearing headband 10, respectively. Each of the retaining parts 13 is formed with an inner opening 131, an outer opening 132 and a receiving chamber 130. The receiving chamber 130 is formed between the inner opening 131 and the outer opening 132.

Figure 3A:
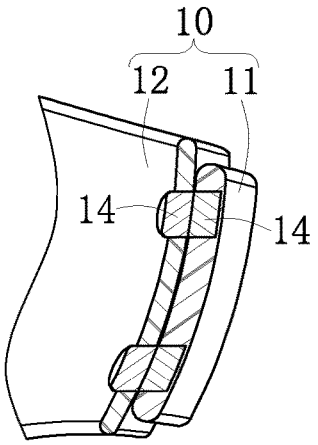
FIG. 3A is a cross-sectional view along an IIIA-IIIA line in FIG. 3 according to the present disclosure.

Reference is made to FIG. 1. In this embodiment, the annular wearing headband 10 includes an outer strap 11 and an inner strap 12. The inner opening 131 is formed on the inner strap 12, and the outer opening 132 is formed on the outer strap 11. The inner strap 12 is detachably connected to the outer strap 11. The annular wearing headband 10 can have a plurality of fastening elements 14 to combine the inner strap 12 with the outer strap 11. As shown in FIG. 3 and FIG. 3A, the fastening element 14, for example, can be magnets or buckles . . . etc. Therefore, user can clean or replace the inner strap 12, or also replace the outer strap 11, so as to create an integrated annular headphone having a different style.

Reference is made to FIG. 1. The pair of speaker modules 20, 20 are retained in the receiving chambers 130 of the retaining part 13. Each of the speaker modules 20, 20 has an ear cover 21, a housing 22, and an electroacoustic transducer 23 disposed in the housing 22. The ear cover 21 is fixed to the inner opening 131. The housing 22 is partially exposed outside the outer opening 132. The electroacoustic transducer 23 faces the inner opening 131, and transfers an audio signal to a sound. The ear cover 21 can be attached to the inner strap 12, or fixed in the housing 22 of the speaker module 20.

The annular wearing headband 10 preferably is retractable, for example, it can be made of elastomeric cloth, such as spandex. The elastomeric cloth can be worn stably and comfortably on a user's head and fit in with different head circumferences.

Figure 4:
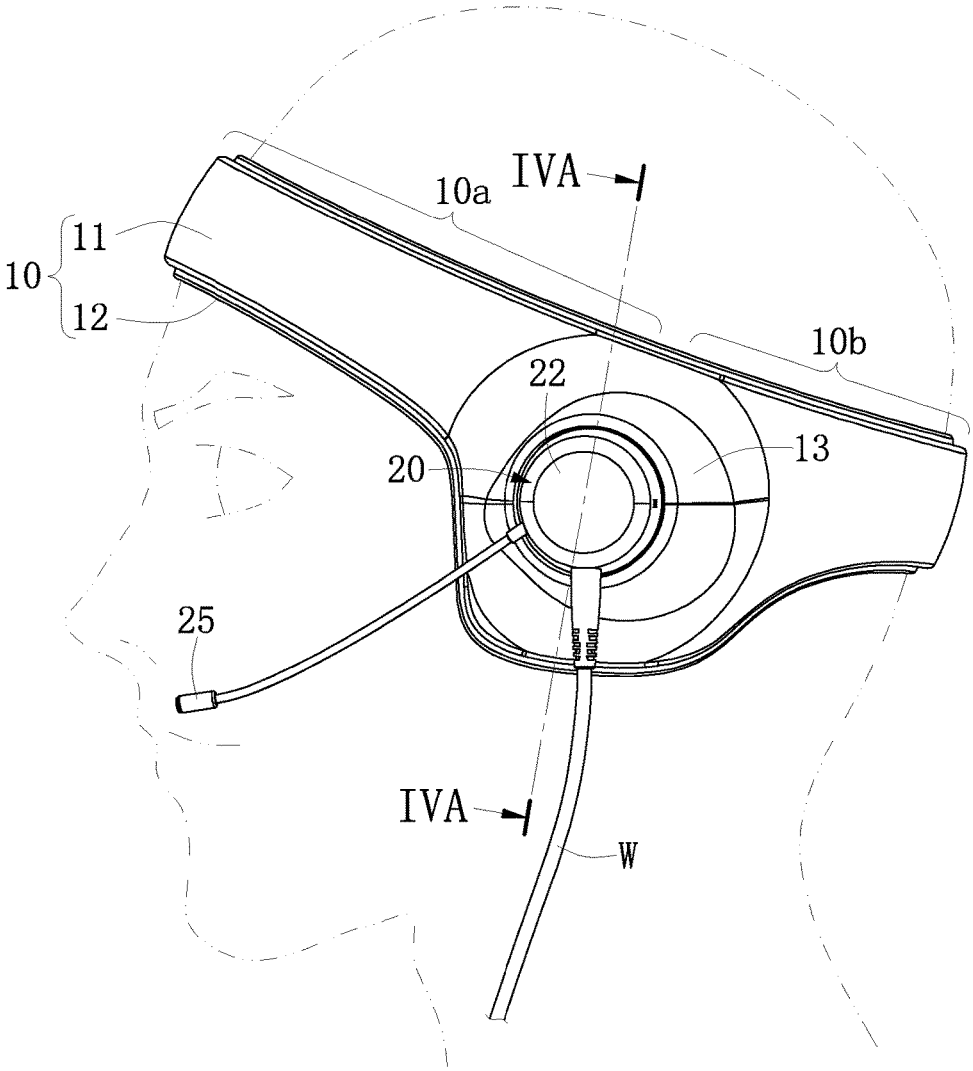
FIG. 4 is a perspective view showing the integrated annular headphone in a usage condition according to the present disclosure.
Figure 4A:
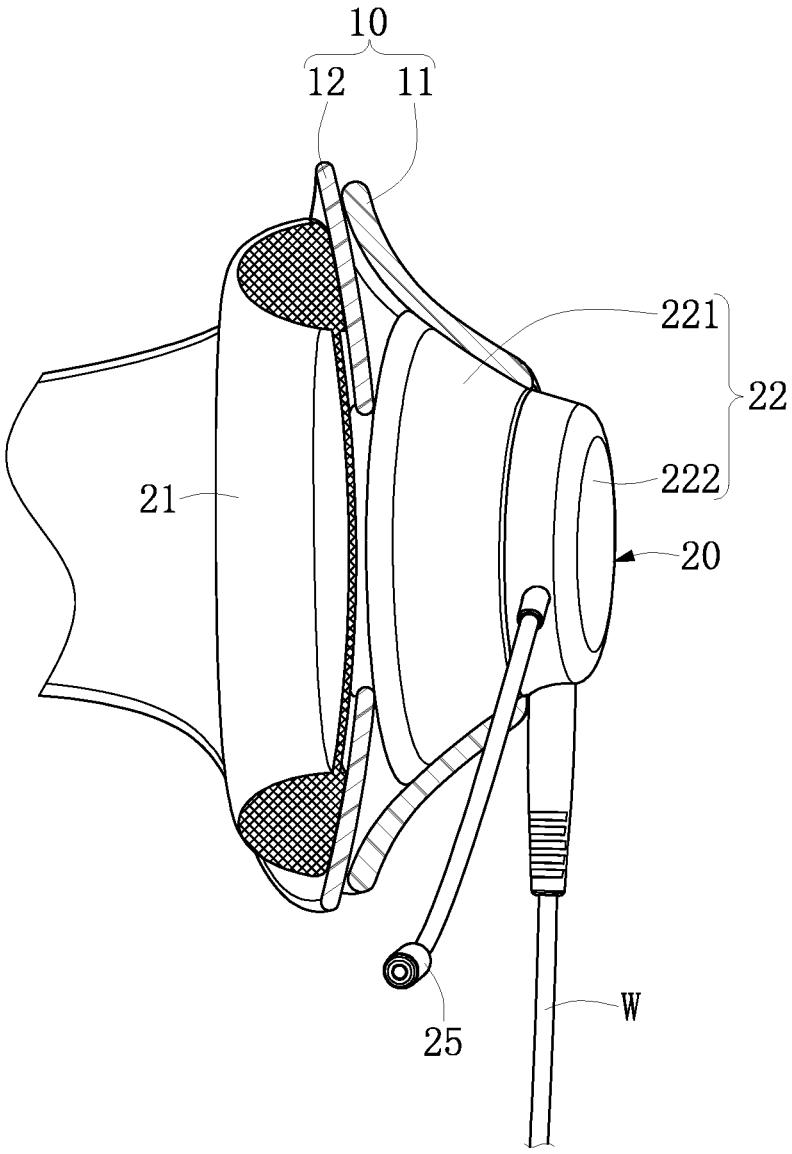
FIG. 4A is a cross-sectional view along an IVA-IVA line in FIG. 4 according to the present disclosure.

Reference is made to FIG. 4. The speaker module 20 can further have a microphone 25, but it is not limited thereto. In addition, the speaker module 20 can connect with a cable W, and the cable W can be detachably inserted in the speaker module 20 by an audio plug. Reference is made to FIG. 4A. In this embodiment, the housing 22 includes a fixing part 221 and a rotational part 222. The rotational part 222 is rotatably connected to the fixing part 221. The microphone 25 is connected to the rotational part 222, so that the angle of the microphone 25 can be adjusted by rotating the rotational part 222, as shown in FIG. 4.

Figure 5:
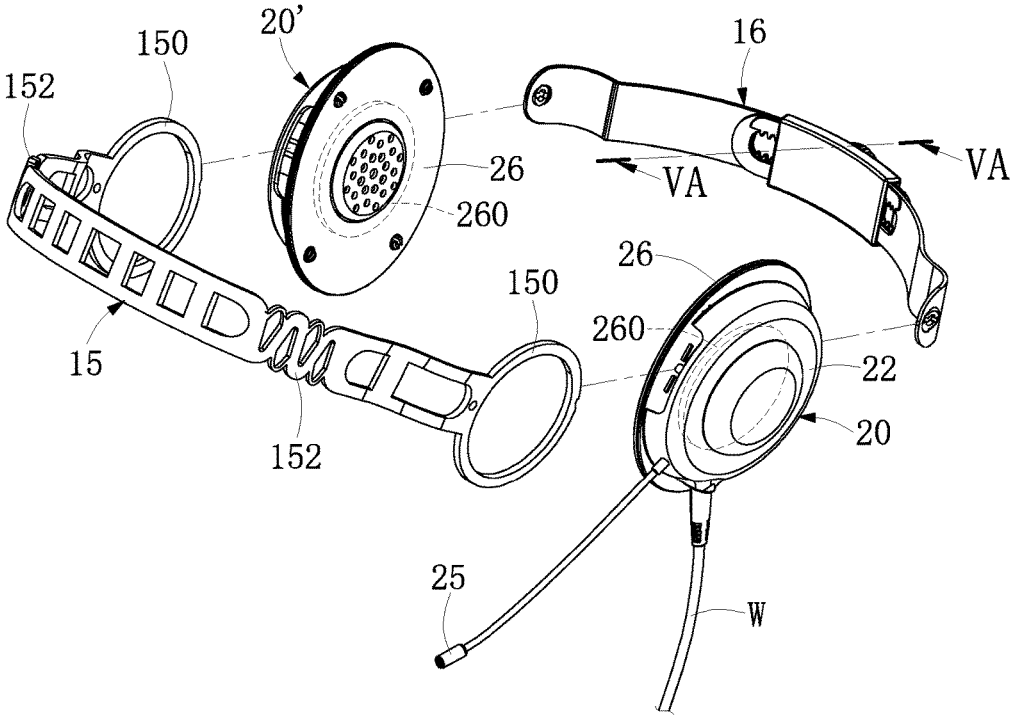
FIG. 5 is an exploded perspective view of another embodiment of the integrated annular headphone according to the present disclosure.
Figure 6:
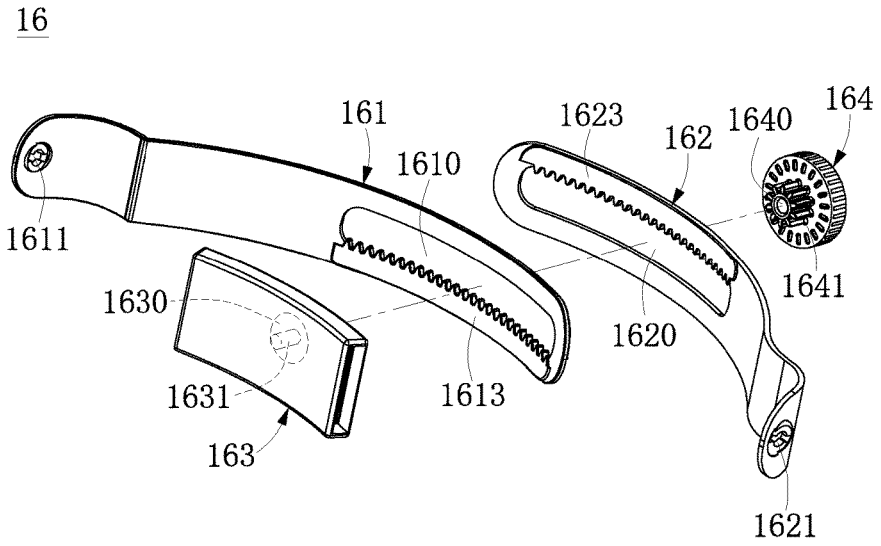
FIG. 6 is an exploded perspective view of the rear lining belt of the present disclosure.

Reference is made to FIG. 5 and FIG. 6. FIG. 5 is an exploded perspective view of the integrated annular headphone of another embodiment. In this embodiment, the drawing omits the annular wearing headband 10 for being illustrated concisely. The present disclosure can further include a front lining belt 15 and a rear lining belt 16 in the annular wearing headband 10. The front lining belt 15 is retained in the first half section 10*a* of the annular wearing headband 10, and the rear lining belt 16 is retained in the second half section 10*b* of the annular wearing headband 10.

Figure 8:
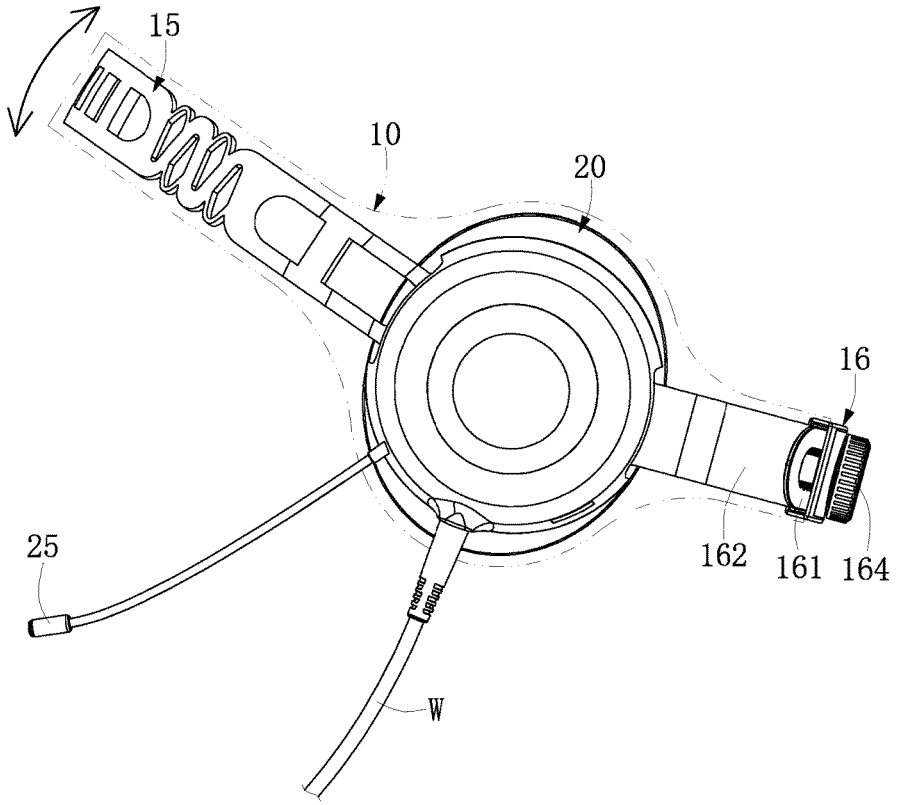
FIG. 8 is a side view of the integrated annular headphone according to another embodiment of the present disclosure.

In this embodiment, the front lining belt 15 has two ends which respectively have a pivotal ring 150. The pivotal rings 150 are rotatably connected to the speaker modules 20, 20', so that the front lining belt 15 is able to adjust an angle related to the rear lining belt 16, as shown in FIG. 8. The connecting manner can be that, for example, the speaker module 20 has an inner housing 26, and the inner housing 26 has an annular protrusion 260. The pivotal ring 150 is rotatably connected to the annular protrusion 260.

In addition, the front lining belt 15 can be integrated with an elastic portion 152, so that it can easily retract for adjusting its length. The front lining belt 15 in this embodiment has two elastic portions 152.

Reference is made to FIG. 6, which is an exploded perspective view of the integrated annular headphone according to the present disclosure. In this embodiment, the rear lining belt 16 has a length adjusting mechanism, so that the user can manually adjust the total length of the annular wearing headband. The rear lining belt 16 includes a first half-belt 161, a second half-belt 162 and an adjusting module (including elements 163, 164). The first half-belt 161 has one end which is connected to the speaker module 20 and the other end which is connected to the speaker module 20'. In this embodiment, the first half-belt 161 is formed with a buckling button 1611, which can be fastened to the inner housing 26 of the speaker module 20. The other end of the first half-belt 161 is formed with a first adjusting slot 1610. In this embodiment, the second half-belt 162 is formed with a buckling button 1621, which can be fastened to the inner housing 26 of the speaker module 20'. The other end of the second half-belt 162 is formed with a second adjusting slot 1620. The adjusting module (including elements 163, 164) passes through the first adjusting slot 1610 of the first half-belt 161 and the second adjusting slot 1620 of the second half-belt 162, so that the total length of the rear lining belt 16 can be adjusted through the adjusting module.

Figure 5A:
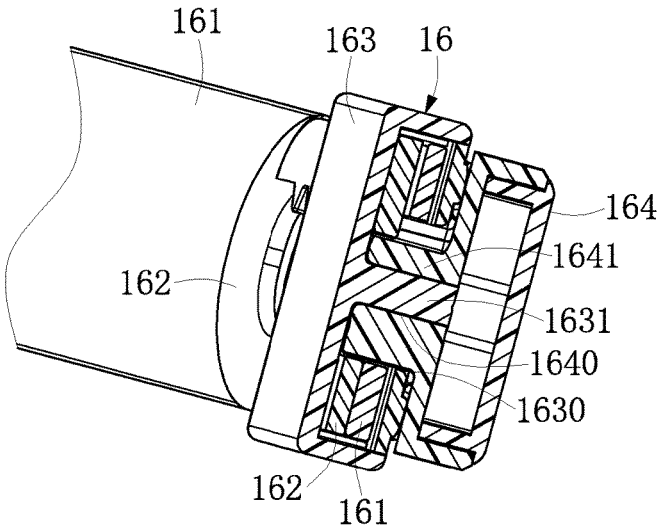
FIG. 5A is a cross-sectional view of a rear lining belt of the present disclosure.

Reference is made to FIG. 5A, which is a cross-sectional view of the rear lining belt and the adjusting module of the present disclosure. The first half-belt 161 has a first rack gear 1613 formed at one side of the first adjusting slot 1610. The second half-belt 162 has a second rack gear 1623 formed at one side of the second adjusting slot 1620. The adjusting module includes an engaging element 163 and an adjusting button 164. The first adjusting slot 1610 and the second adjusting slot 1620 are stacked and disposed in the engaging element 163. The first rack gear 1613 and the adjusting button 164 pass through the engaging element 163 and are engaged with the first rack gear 1613 and the second rack gear 1623. In detail, the engaging element 163 has an opening 1630 and a rod 1631 disposed in the opening 1630. The adjusting button 164 has a pinion gear 1641, and the pinion gear 1641 is formed with a pinion hole 1640 at a central part thereof. The rod 1631 is plugged in the pinion hole 1640 of the pinion gear 1641. The pinion gear 1641 passes through the opening 1630 and is simultaneously engaged with the first rack gear 1613 and the second rack gear 1623.

When the adjusting button 164 is rotated counterclockwise as shown in FIG. 6, the pinion gear 1641 of the adjusting button 164 drives the first rack gear 1613 and the second rack gear 1623. The first half-belt 161 and the second half-belt 162 are drawn to be closer to each other, so that the total length of the rear lining belt 16 is shortened. When the adjusting button 164 is rotated clockwise as shown in FIG. 6, the pinion gear 1641 of the adjusting button 164 drives the first rack gear 1613 and the second rack gear 1623. The first half-belt 161 and the second half-belt 162 are pulled away from each other, so that the total length of the rear lining belt 16 is increased.

Figure 7:
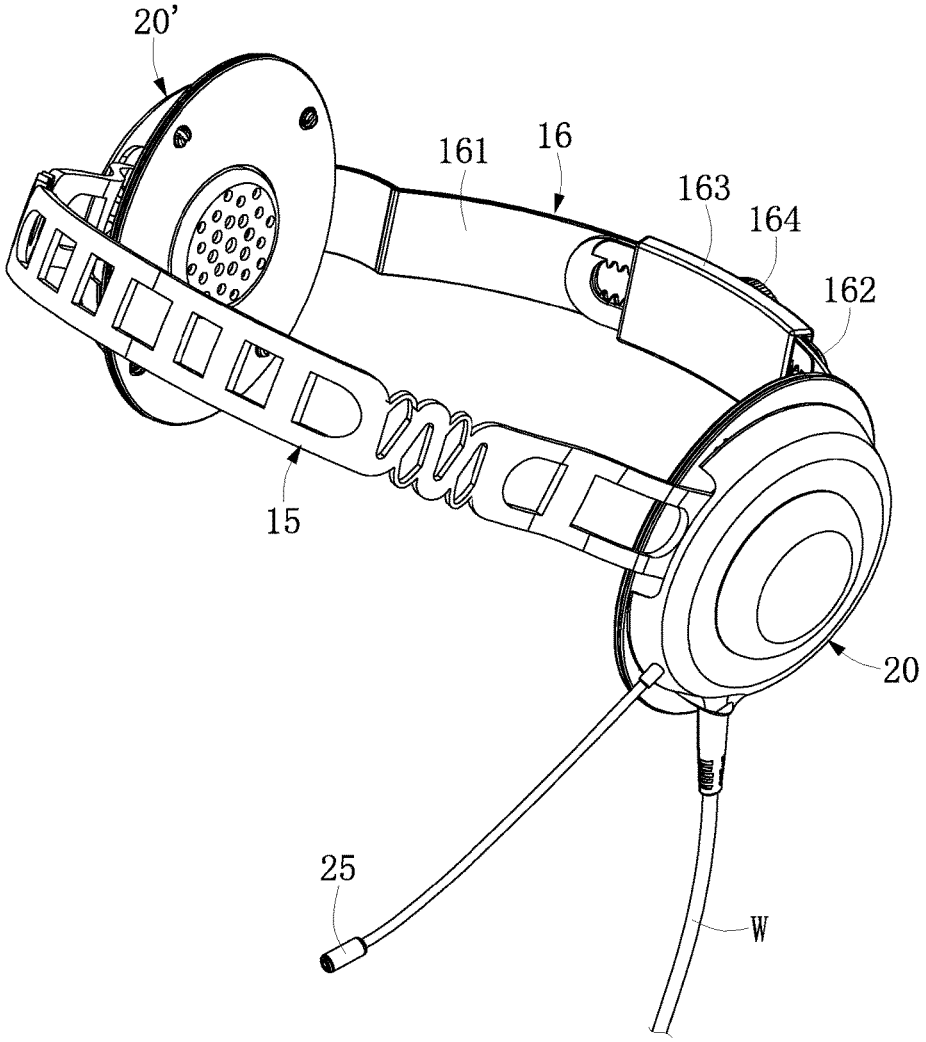
FIG. 7 is an assembled perspective view of an integrated annular headphone according to another embodiment of the present disclosure.

Reference is made to FIG. 7 and FIG. 8, which are respectively an assembled perspective view and a side view of the integrated annular headphone according to the present disclosure. In this embodiment, the front lining belt 15 and the rear lining belt 16 are like a skeleton of the annular wearing headband 10, as shown in FIG. 8. The annular wearing headband 10 wraps around the front lining belt 15 and the rear lining belt 16. However, the adjusting button 164 is partially exposed outside a back side of the annular wearing headband 10.

Unlike the conventional C-shaped earmuff headphone which clamps a user's head, the present disclosure has features and functions that the integrated annular headphone 100 is provided to combine two speaker modules 20, 20' with a retractable and replaceable annular wearing headband 10, which surrounds the user's forehead and back head. The present disclosure is able to avoid affecting the user's hairstyle. The retractable annular wearing headband 10 can be worn stably and comfortably on the user's head and fit in with different head circumferences. In addition, it is also convenient for the user to do exercise. The replaceable annular wearing headband 10 is not only suitable for cleaning, but also matches the user's clothing collocation conspicuously.

The descriptions illustrated supra set forth simply the preferred embodiments of the present disclosure; however, the characteristics of the present disclosure are by no means restricted thereto. All changes, alterations, or modifications conveniently considered by those skilled in the art are deemed to be encompassed within the scope of the present disclosure delineated by the following claims.

What is claimed is:

1. An integrated annular headphone, comprising:

an annular wearing headband having a first half section, a second half section and two retaining parts, wherein the first half section is connected to the second half section to form a closed-loop manner, and the two retaining parts are respectively disposed at two sides of the annular wearing headband; wherein each of the retaining parts is formed with an inner opening, an outer opening and a receiving chamber, and the receiving chamber is arranged between the inner opening and the outer opening;

wherein the annular wearing headband includes an outer strap and an inner strap, wherein the inner opening is formed on the inner strap, the outer opening is formed on the outer strap, and the inner strap is detachably connected to the outer strap; and a pair of speaker modules, respectively retained in the retaining parts, each of the speaker modules having an ear cover, a housing and an electroacoustic transducer disposed in the housing; the ear cover being fixed to the inner opening, the housing partially exposed outside the outer opening, the electroacoustic transducer facing the inner opening.

2. The integrated annular headphone as claimed in claim 1, wherein the annular wearing headband includes a plurality of fastening elements to combine the inner strap with the outer strap.

3. The integrated annular headphone as claimed in claim 1, wherein the annular wearing headband is retractable.

4. The integrated annular headphone as claimed in claim 1, further comprising a front lining belt and a rear lining belt, wherein the front lining belt is retained in the first half section of the annular wearing headband, and the rear lining belt is retained in the second half section of the annular wearing headband.

5. The integrated annular headphone as claimed in claim 4, wherein the front lining belt has two ends respectively formed with a pivotal ring, and the pivotal ring is pivotally connected to the speaker module, so that the front lining belt adjusts an angle related to the rear lining belt.

6. The integrated annular headphone as claimed in claim 5, wherein the speaker module further includes an inner housing; wherein the inner housing has an annular protrusion, and the pivotal ring is rotatably connected to the annular protrusion.

7. The integrated annular headphone as claimed in claim 4, wherein the rear lining belt has a first half-belt, a second half-belt and an adjusting module; wherein the first half-belt has one end which is connected to one of the speaker modules and the other end which is formed with a first adjusting slot; wherein the second half-belt has one end which is connected to the other one of the speaker modules and the other end which is formed with a second adjusting slot; the adjusting module passing through the first adjusting slot of the first half-belt and the second adjusting slot of the second half-belt, so as to adjust a total length of the rear lining belt.

8. The integrated annular headphone as claimed in claim 7, wherein the first half-belt has a first rack gear formed at one side of the first adjusting slot, and the second half-belt has a second rack gear formed at one side of the second adjusting slot; wherein the adjusting module includes an engaging element and an adjusting button, the first adjusting slot and the second adjusting slot are stacked and disposed in the engaging element, the first rack gear and the adjusting button passing through the engaging element are engaged with the first rack gear and the second rack gear.

9. The integrated annular headphone as claimed in claim 8, wherein the engaging element includes an opening and a rod disposed in the opening; wherein the adjusting button has a pinion gear, and the pinion gear is formed with a pinion hole at a central part thereof; the rod being plugged in the pinion hole of the pinion gear, the pinion gear passing through the opening and simultaneously engaged with the first rack gear and the second rack gear.

10. An integrated annular headphone, comprising:

an annular wearing headband having a first half section, a second half section and two retaining parts, wherein the first half section is connected to the second half section to form a closed-loop manner, and the two retaining parts are respectively disposed at two sides of the annular wearing headband; wherein each of the retaining parts is formed with an inner opening, an outer opening and a receiving chamber, and the receiving chamber is arranged between the inner opening and the outer opening; and a pair of speaker modules, respectively retained in the retaining parts, each of the speaker modules having an ear cover, a housing and an electroacoustic transducer disposed in the housing; the ear cover being fixed to the inner opening, the housing partially exposed outside the outer opening, the electroacoustic transducer facing the inner opening;

a front lining belt being retained in the first half section of the annular wearing headband; and a rear lining belt being retained in the second half section of the annular wearing headband.

11. The integrated annular headphone as claimed in claim 10, wherein the annular wearing headband includes an outer strap and an inner strap, wherein the inner opening is formed on the inner strap, the outer opening is formed on the outer strap, and the inner strap is detachably connected to the outer strap.

12. The integrated annular headphone as claimed in claim 11, wherein the annular wearing headband includes a plurality of fastening elements to combine the inner strap with the outer strap.

13. The integrated annular headphone as claimed in claim 10, wherein the annular wearing headband is retractable.

14. The integrated annular headphone as claimed in claim 10, wherein the front lining belt has two ends respectively formed with a pivotal ring, and the pivotal ring is pivotally connected to the speaker module, so that the front lining belt adjusts an angle related to the rear lining belt.

15. The integrated annular headphone as claimed in claim 14, wherein the speaker module further includes an inner housing; wherein the inner housing has an annular protrusion, and the pivotal ring is rotatably connected to the annular protrusion.

16. The integrated annular headphone as claimed in claim 10, wherein the rear lining belt has a first half-belt, a second half-belt and an adjusting module; wherein the first half-belt has one end which is connected to one of the speaker modules and the other end which is formed with a first adjusting slot; wherein the second half-belt has one end which is connected to the other one of the speaker modules and the other end which is formed with a second adjusting slot; the adjusting module passing through the first adjusting slot of the first half-belt and the second adjusting slot of the second half-belt, so as to adjust a total length of the rear lining belt.

17. The integrated annular headphone as claimed in claim 16, wherein the first half-belt has a first rack gear formed at one side of the first adjusting slot, and the second half-belt has a second rack gear formed at one side of the second adjusting slot; wherein the adjusting module includes an engaging element and an adjusting button, the first adjusting slot and the second adjusting slot are stacked and disposed in the engaging element, the first rack gear and the adjusting button passing through the engaging element are engaged with the first rack gear and the second rack gear.

18. The integrated annular headphone as claimed in claim 17, wherein the engaging element includes an opening and a rod disposed in the opening; wherein the adjusting button has a pinion gear, and the pinion gear is formed with a pinion hole at a central part thereof; the rod being plugged in the pinion hole of the pinion gear, the pinion gear passing through the opening and simultaneously engaged with the first rack gear and the second rack gear.

* * * * *